United States Patent [19]

Chang et al.

[11] Patent Number: 5,046,872

[45] Date of Patent: Sep. 10, 1991

[54] PRINTER ACTUATED BY PIEZOELECTRICALLY GENERATED SHOCK WAVE

[75] Inventors: Paul S. H. Chang, Briarcliff Manor; Han C. Wang, Chappaqua, both of N.Y.

[73] Assignee: IBM Corporation, Yorktown, N.Y.

[21] Appl. No.: 481,649

[22] Filed: Feb. 13, 1990

Related U.S. Application Data

[63] Continuation of Ser. No. 264,535, Oct. 31, 1988, abandoned.

[51] Int. Cl.[5] ..... B41J 9/26; B41J 2/295

[52] U.S. Cl. ..... 400/157.1; 400/124; 310/328; 310/334

[58] Field of Search ..... 400/121, 124, 157.1, 400/157.2; 310/316, 318, 322, 323, 325, 328, 334

[56] References Cited

U.S. PATENT DOCUMENTS

| | | | |
|---|---|---|---|
| 3,473,466 | 10/1969 | Thayer | 310/328 |
| 3,614,486 | 10/1971 | Smiley | 101/212 |
| 4,193,703 | 3/1980 | Sakmann | 400/124 |
| 4,272,200 | 6/1981 | Mehl | 400/124 |
| 4,348,119 | 9/1982 | Carson | 400/157.2 |
| 4,382,202 | 3/1983 | Herchenbach | 310/328 |
| 4,457,636 | 7/1984 | Nusser | 400/121 |
| 4,480,934 | 11/1984 | Herman | 400/124 |
| 4,547,086 | 10/1985 | Matsumoto et al. | 400/124 |
| 4,589,786 | 5/1986 | Fukui et al. | 400/124 |
| 4,613,241 | 9/1986 | Kitagawa | 400/121 |
| 4,703,215 | 10/1987 | Asano | 310/328 |
| 4,781,477 | 11/1988 | Nagasawa | 400/124 |
| 4,783,610 | 11/1988 | Asano | 310/328 |
| 4,886,382 | 12/1989 | Oota | 310/328 |
| 4,926,100 | 5/1990 | Patterson | 400/124 |
| 4,944,222 | 7/1990 | Tyren | 310/328 |
| 4,976,553 | 12/1990 | Yamaguchi | 310/328 |
| 4,979,275 | 12/1990 | Sakaida | 310/328 |

FOREIGN PATENT DOCUMENTS

| | | | |
|---|---|---|---|
| 0266977 | 11/1986 | European Pat. Off. | 400/124 |
| 59-103766 | 6/1984 | Japan | 400/124 |
| 59-103767 | 6/1984 | Japan | 400/124 |
| 59-215871 | 12/1984 | Japan | 400/124 |
| 60-38172 | 2/1985 | Japan | 400/124 |

OTHER PUBLICATIONS

Patent Abstracts of Japan, vol. 12, No. 321 (M-736)(3168), 31 Aug. 1988, & JP-A-63 89353 (Uchikawa), 20 Apr. 1988, *the whole document*.

Patent Abstracts of Japan, vol. 10, No. 375 (M-545)(2432) 13 Dec. 1986, & JP-A-61 167582 (OOTA) 29 Jul. 1986, *the whole document*.

Patent Abstracts of Japan, vol. 11, No. 78 (M-570)(2525), 10 Mar. 1987, & JP-A-61 233559 (Uchikawa), 17 Oct. 1986, *the whole document*.

Patent Abstracts of Japan, vol. 8, No. 191 (M-322)(1628) 4 Sep. 1984, & JP-A-59 81181 (Inoue), 10 May 1984, *the whole document*.

Patent Abstracts of Japan, vol. 11, No. 67 (M-566)(2514), 28 Feb. 1987, & JP-A-61 225067 (Oota) 06 Oct. 1986, *the whole document*.

*Primary Examiner*—David A. Wiecking
*Assistant Examiner*—Steven S. Kelley
*Attorney, Agent, or Firm*—Perman & Green

[57] ABSTRACT

An impact printer is described which includes a shock wave generator means, a print hammer, and a solid wave guide interposed between the shock wave generator and print hammer. The solid wave guide acts to transmit a shock wave from the shock wave generator to the print hammer to cause its movement towards a substrate upon which printing is to occur. In a preferred embodiment, the shock wave generator comprises a piezoelectric or electrostrictive actuator, which actuator is held in compression by a frame that prevents any substantial longitudinal movement thereof. In a further preferred embodiment, circuitry is connected to the actuator for detecting, after an actuation, the return of the hammer into contact with the solid wave guide. In response to that detection, the circuitry provides a signal which enables operation of the shock wave generator.

14 Claims, 4 Drawing Sheets

FIG. 5
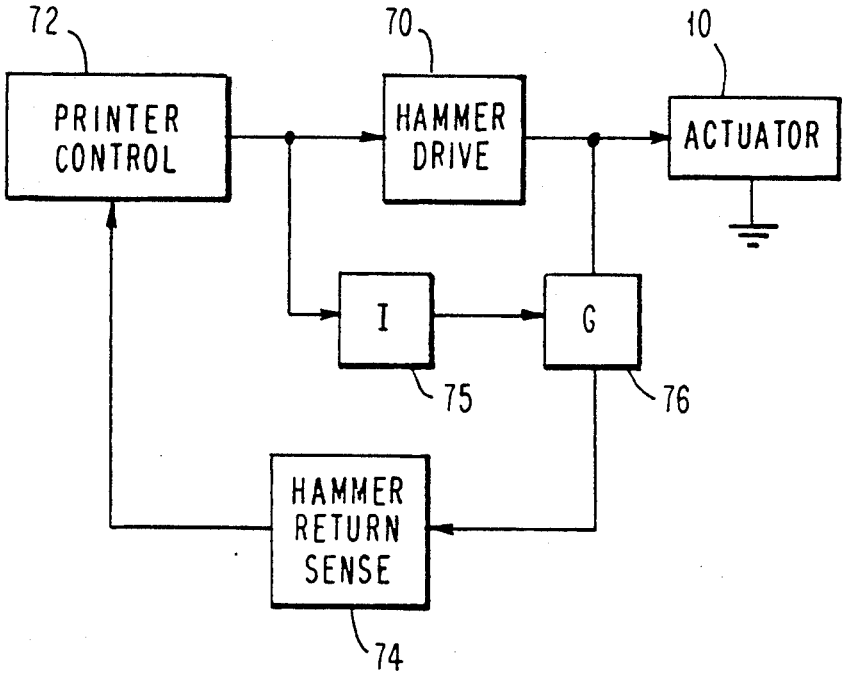
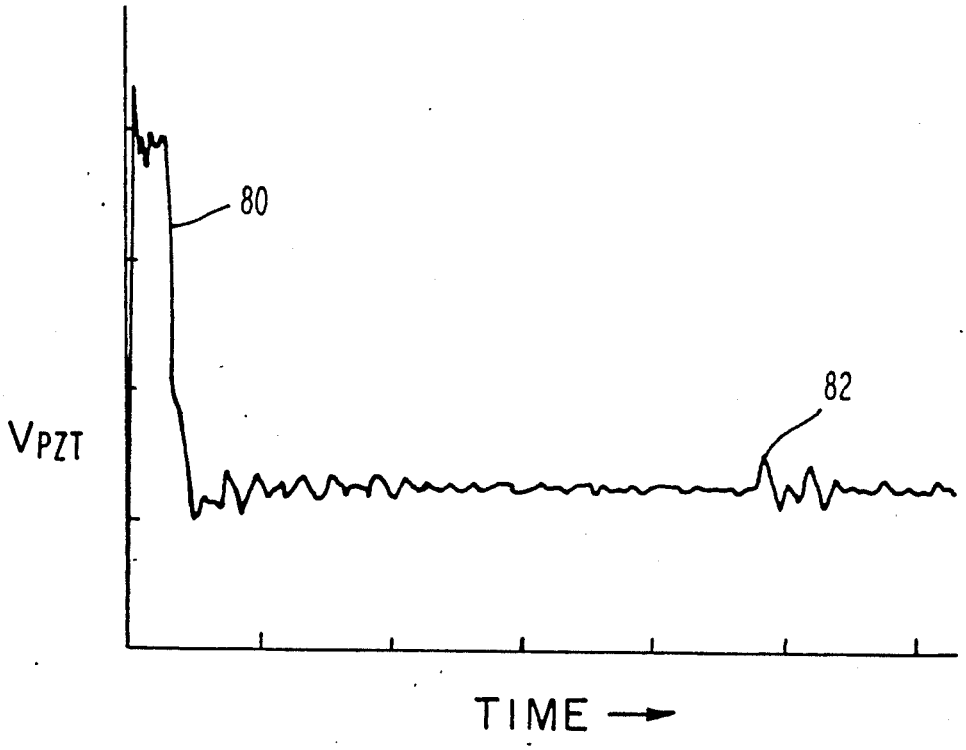
FIG. 6

PRINTER ACTUATED BY PIEZOELECTRICALLY GENERATED SHOCK WAVE

This is a continuation of copending application Ser. No. 07/264,535 filed on Oct. 31, 1988, now abandoned.

FIELD OF THE INVENTION

This invention relates to matrix printers and, more particularly, to a matrix printer that is shock-driven by a piezoelectric actuator.

DESCRIPTION OF THE PRIOR ART

Piezoelectric driven impact printers are known in the art. Compared with conventional electromagnetic actuated impact printers, they exhibit higher printing speeds, lower energy consumption and less generation of heat. Nevertheless, most piezoelectric driven dot matrix printers exhibit significant deficiencies in their operation or structure. While some have been embodied into commercial printers, in general, they require significant maintenance and adjustment over the lifetime of the printer.

In U.S. Pat. No. 4,589,786 to Fukui et al, both single and dual piezoelectric driven, wire, dot matrix printers are described which employ a complicated two-stage differential linkage to achieve wire displacement amplification. The motion of the linkage (which is required to achieve amplification of the movement of the piezoelectric actuator(s)) consumes significant mechanical energy, restricts the distance of wire travel and causes the printing force to drop off when print wire travel exceeds a certain distance.

Another piezoelectrically driven print mechanism is shown in U.S. Pat. No. 4,547,086 to Matsumoto et al. The structure described therein employs opposed piezoelectric actuators whose combined movements cause a lever, on which is mounted a print wire, to pivot in the direction of the paper on which printing is to occur. This system suffers the same drawbacks as the Fukui et al system. Similar mechanical piezoelectric driven print wire mechanisms are shown in Japanese Patents 59-103766 and 59-103767.

In Japanese Patents 59-215871 and 60-38172 a piezoelectric actuator is employed to induce a surface wave in a high friction elastomer which is, in turn, coupled to a pressure contact plate/print wire combination. When the piezoelectric actuator is energized, a surface wave is generated in the elastomer material which causes the print wire to be extended.

In U.S. Pat. No. 4,193,703 to Sakmann, still another type of piezoelectrically driven print mechanism is shown wherein a print wire is attached to a buckling spring. When a piezoelectric element coupled to the spring is energized, the spring extends the print wire. One embodiment of Sakmann's print mechanism employs a print wire which rests on but is not connected to the buckling spring. This, to some extent, overcomes the limitation of limited print wire movement characteristic of other print wire actuators. However, the Sakmann actuator is still dependent upon the amount of movement of the piezoelectric actuator which is, by its nature, limited.

Kitagawa, in U.S. Pat. No. 4,613,241 has a shock-wave operated, wire matrix printer wherein each wire is coupled to a sealed flexible container which contains opposed electrodes and a pressure transmitting medium. A discharge is caused to occur between the electrodes so that the container expands and drives the print wire towards the paper. This construct overcomes some problems of the prior art but requires the use of a continuous, spark-type discharge which not only creates electro-magnetic interference problems but also creates lifetime limiting problems for the actuator.

Accordingly, it is an object of this invention to provide a piezoelectrically driven, print wire actuator wherein the length of travel of the print wire is not restricted by the actuator.

It is another object of this invention to provide a piezoelectrically operated print wire actuator wherein the amount of movement of the piezoelectric element does not act as a limiting factor on the movement of the print wire.

It is still a further object of this invention to provide a piezoelectrically operated print wire actuator of simple and inexpensive design.

It is still a further object of this invention to provide a piezoelectrically operated print wire actuator which consumes minimum power.

SUMMARY OF THE INVENTION

An impact printer actuator is described which includes shock wave generating means, a print hammer, and solid wave guide means interposed between the shock wave generator and print hammer. The solid wave guide means acts to transmit a shock wave from the shock wave generator to the print hammer to cause its movement towards a substrate upon which printing is to occur. In a preferred embodiment, the shock wave generator comprises a piezoelectric actuator, which actuator is held in compression by a frame that prevents any substantial longitudinal movement thereof. In a further preferred embodiment, sense means are connected to the piezoelectric actuator for detecting, after an actuation, the return of the hammer into contact with the wave guide means. In response to that detection, the sense means provides a signal which enables operation of the shock wave generator.

DESCRIPTION OF THE DRAWINGS

FIG. 5 is a high level block diagram of a circuit for energizing the piezoelectric actuator.

FIG. 6 is a plot of voltage applied to the piezoelectric actuator and the voltage induced by the impact force of the hammer return on the actuator.

DETAILED DESCRIPTION OF THE INVENTION

Figure 1:
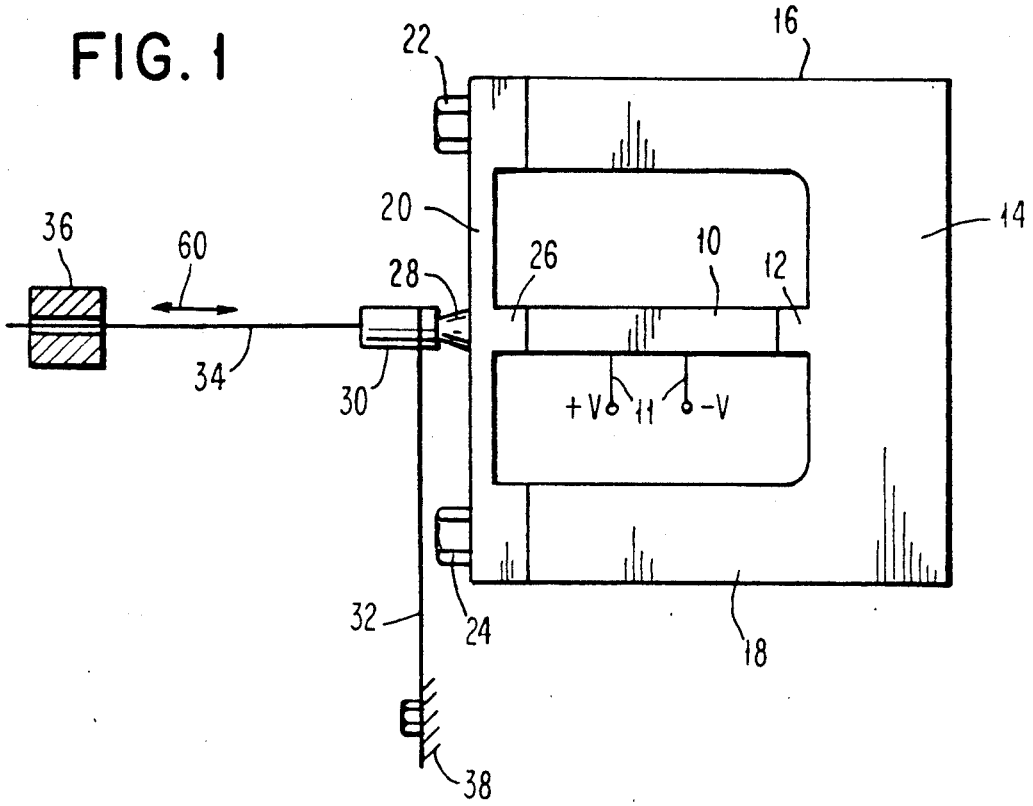
FIG. 1 is a side view of a print wire actuator which embodies the invention.
Figure 2:
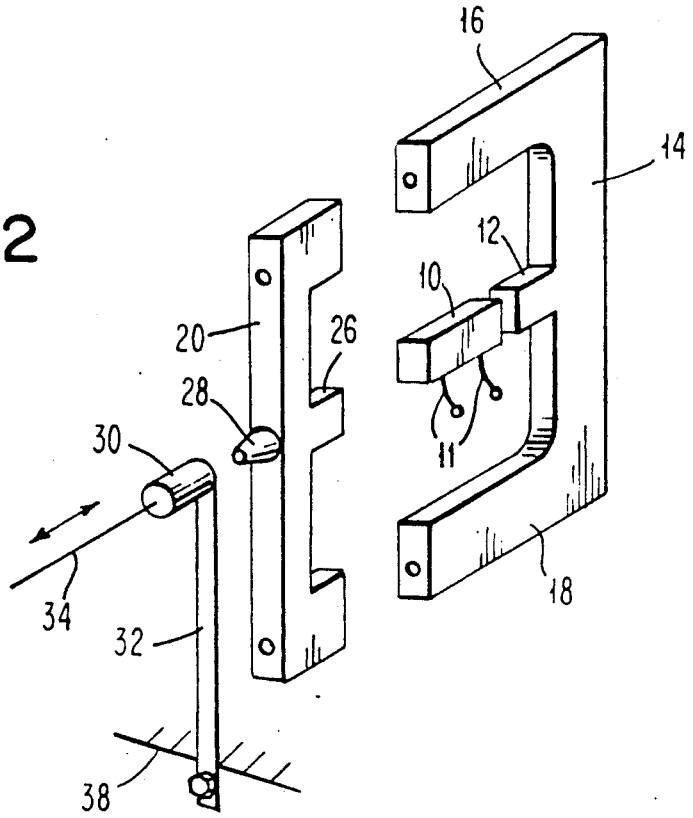
FIG. 2 is an exploded, isometric view of the print wire actuator shown in FIG. 1.

Turning now to FIGS. 1 and 2, an electrostrictive or piezoelectric ceramic actuating element 10 is fixed to middle arm 12 of frame 14. Electrical conductors 11 provide energizing signals to actuating element 10. Frame 14 is E-shaped and has upper arm 16 and lower arm 18. A beam 20 extends from upper arm 16 to lower arm 18 and is attached thereto by cap screws 22 and 24. An extension 26 from beam 20 is equidistantly located between arms 16 and 18 and bears upon actuating element 10 to maintain it in compression. When cap screws 22 and 24 are tightened, beam 20 is caused to flex so that extension 26 bears upon element 10 and compresses it against middle arm 12.

Immediately adjacent extension 26 is solid wave guide portion 28. A print hammer 30 is mounted on leaf spring 32 and has one end which bears against wave guide portion 28. The other end of print hammer 30 has attached to it a print wire 34 which extends through wire guide 36. Spring 32 is rigidly attached to a fixed point 38.

As can be better seen in FIG. 2, the preferred shape of wave guide portion 28 is conical so as to assure maximum energy transfer to print hammer 30. The conical structure acts to concentrate the wave energy so that it is most intense at the point of contact between wave guide portion 28 and print hammer 30. In the preferred embodiment, the mass of beam 20 extension 26 and wave guide portion 28 are approximately made equal to the mass of print hammer 30. In addition, beam 20 and frame 14 are constructed of a material (e.g., steel, aluminum) which provides substantial stiffness so that when actuating element 10 is energized, little or no expansion of its length occurs and the energy induced into extension 26 is essentially of a pure shock wave nature.

Figure 3:
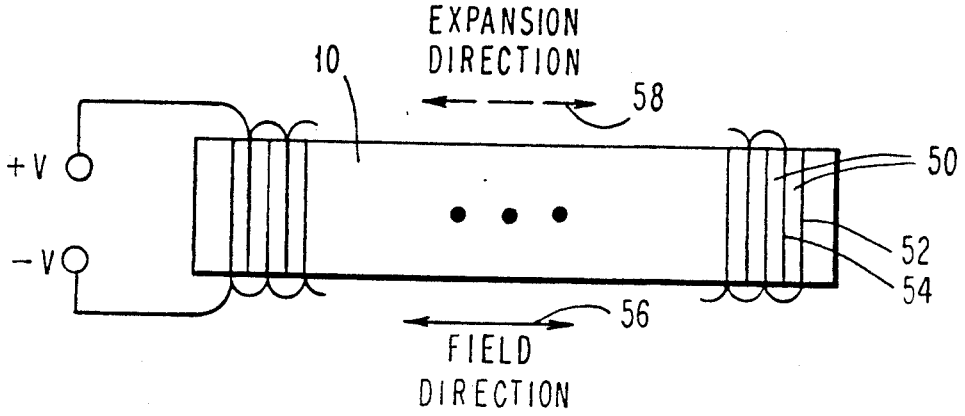
FIG. 3 is a schematic showing of a piezoelectric actuator usable with the invention hereof.

Actuating element 10 is preferably, a piezoelectric actuator of the multilayer type. Such an actuator includes a number of piezoelectric plates, stacked together with internal electrodes so that an applied voltage thereacross causes the actuator to expand in its longitudinal direction. The plates are laminated one upon the other and provide substantial force and displacement when energized. Such a structure is schematically shown in FIG. 3 and comprises a plurality of ceramic layers 50 with interspersed electrodes 52, 54, etc. The field induced in the ceramic plates by an applied voltage has the direction shown by arrow 56 and causes the actuator to expand in the directions shown by arrow 58. When a voltage is applied across electrodes 52 and 54, a stress wave is generated in the actuator 10 through the known $d_{33}$ piezoelectric effect.

Figure 4:
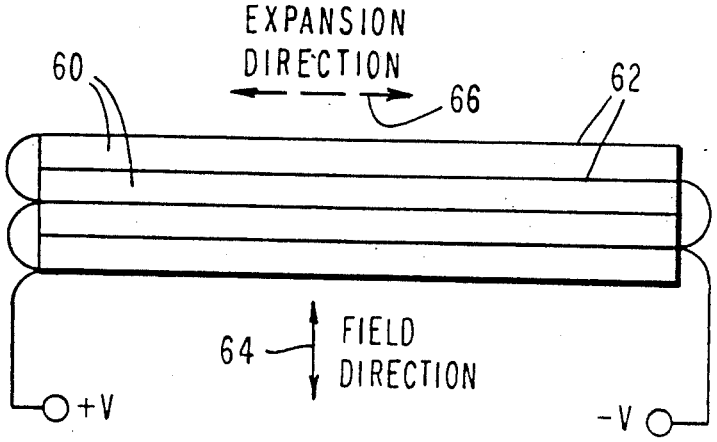
FIG. 4 is a schematic showing of another type of piezoelectric actuator usable with the invention hereof.

An alternate actuator structure as shown in FIG. 4 and comprises elongated ceramic plates 60 with interspersed electrodes 62. In this instance, the field direction is as shown by arrows 64 and the expansion direction occurs as shown by arrows 66. As is known, a stress wave created by the application of a voltage across electrodes 62 is generated by the $d_{31}$ piezoelectric effect. Since, the $d_{33}$ piezoelectric effect is substantially larger than the $d_{31}$ piezoelectric effect, the actuator structure shown in FIG. 3 is preferred.

Still another appropriate actuator, which is suitable, is an electrostrictive actuator, preferably of the PMN variety (e.g., a Pb, Mg, Niobate composition).

The operation of the matrix printer actuator shown in FIGS. 1 and 2 commences when a voltage pulse is applied to actuator 10. The voltage pulse creates a shock wave therein which is generated by the fast response characteristics of the actuator. Since however, actuator 10 is constrained from expansion by middle arm 12 of frame 14 and extension 26 from beam 20, an induced shock wave propagates into both arm 12 and extension 26. The portion of the shock wave which propagates into extension 26, enters solid conical wave guide portion 28 and is caused to converge to its reduced cross section area. Leaf spring 32 maintains print hammer 30 in contact with wave guide portion 28. Thus, when the induced shock wave appears at the reduced cross section of wave guide portion 28, it is transmitted to print hammer 30. As a result hammer 30 moves rapidly to the left (in the direction shown by arrow 60). Print wire 34 is thus caused to move through guide 36 and to strike a ribbon, paper and platen in sequence (not shown). Afterwards, hammer 30 is caused to return to wave guide portion 28 due to collision rebound forces and the restoration force exerted by spring 32. When print hammer 30 returns to its original position and contacts wave guide portion 28, it is adapted to be fired again.

Referring now to FIG. 5, actuator 10 is energized by hammer drive circuit 70, that is, in turn, operated by printer control 72. As can be understood from an examination of FIG. 1, when hammer 30 returns and impacts upon wave guide portion 28, a shock wave is initiated which travels through beam 20 and extension 26 into actuator 10. The presence of the induced shock wave in actuator 10 is sensed across contacts 11 and is fed through gate 76 to hammer return sense amplifier 74 whose output is, in turn, fed to printer control 72 via conductor 78.

FIG. 6 shows a trace of the voltage applied to actuator 10 and the voltage in actuator 10, induced by the impact of print hammer 30 on wave guide portion 28. In specific, a voltage pulse 80 is initially applied to actuator 10 by hammer drive 70. When hammer 30, on rebound, impacts upon solid wave guide 28, the impact induces pulse voltage 82 in actuator 10, which voltage appears across conductors 11 (see FIG. 1).

When pulse signal 80 from printer control 72 actuates hammer drive 70 to cause a shock wave to be generated in actuator 10, the pulse output from printer control 72 is inverted by inverter 75 and turns off gate 76. This prevents the high voltage output of hammer drive 70 from perturbing hammer return sense amplifier 74. When the output of printer control 72 falls, gate 76 is opened and awaits the appearance of pulse 82 (see FIG. 6). Upon detecting pulse 82, hammer return sense amplifier 74 generates a signal which indicates to printer control 72 that the circuit is ready again to be operated.

Figure 7:
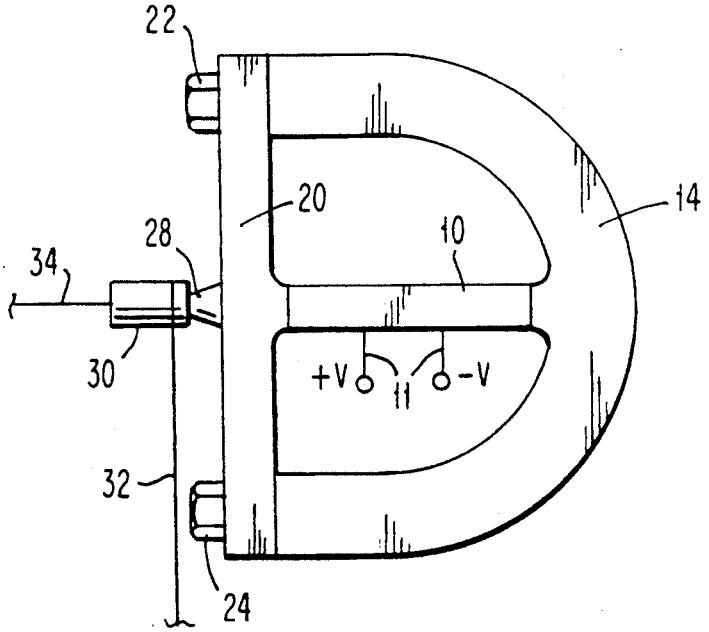
FIG. 7 is a side view of an alternative embodiment of the invention.

As above stated, certain features of the invention provide significant performance improvements over the prior art. Beam 20, extension 26 and middle arm 12 keep actuator element under compression. This protects element 10 from failure due to induced tensile stress and from the impact stress due to the collision of print hammer 30 with wave guide portion 28 during its return motion. Additionally, hammer 30 flies away from wave guide 28 at a high initial speed, without delay, thereby enabling high speed print operation. Spring 32 is made flexible and provides sufficient force to return print hammer 30 back to its original home position so that it bears on wave guide 28. The print energy is adjustable through change of the mass of hammer 30 and allows for changes to accommodate various dot and wire size printing applications. Furthermore, since printing is performed while the hammer and wire assembly operate in free flight motion, the applied print force to the print medium is relatively constant over a wide range of printing strokes. Actuator 10 is further usable as a sensor to detect the hammer return and to provide a "print ready" signal to the printer control so that maximum speed can be achieved without additional control systems. Finally, referring to FIG. 7, while frame 14 is shown in the form of an E, it could be shaped as a C with one extremity of actuator 10 bearing directly on the vertical extent of the C shape.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

What is claimed is:

1. An impact printer comprising:

actuator means for generating a shock wave in a predetermined direction;

print hammer means; and solid wave guide means interposed between said actuator means and said print hammer means for both restraining said actuator means from movement in said predetermined direction and for transmitting said shock wave to said print hammer means, said solid waveguide means including a solid waveguide and frame means for positioning said solid wave guide against said actuator means to maintain said actuator means in compression, whereby said print hammer means is moved to a print position by said transmitted shock wave.

2. The invention as defined in claim 1 wherein said actuation means is selected from the group consisting of piezoelectric and electrostrictive actuators.

3. The invention as defined in claim 1 wherein said frame means exerts sufficient compressive force against said actuator means to prevent substantial longitudinal movement thereof.

4. The invention as defined in claim 2 wherein said print hammer means is supported on flexible means and moves in free flight motion as constrained by said flexible means, upon experiencing said shock wave from said solid wave guide means.

5. The invention as defined in claim 4 wherein said flexible means comprises:

spring means for biasing said print hammer means against a point of contact with said solid wave guide means.

6. The invention as defined in claim 5 wherein said solid wave guide means is shaped to focus said shock wave to said point of contact.

7. The invention as defined in claim 6 wherein said shaped part of said solid wave guide means is conical and has a reduced cross section portion which contacts said print hammer.

8. The invention as defined in claim 7 wherein said actuator has an elongated dimension, said actuator being comprised of laminated ceramic plates with interspersed electrodes, said ceramic plates having major faces oriented orthogonally to said elongated dimension, whereby said actuator creates a shock wave along said elongated dimension when said electrodes are energized.

9. The invention as defined in claim 7 wherein said print hammer has rigidly attached thereto, a print wire.

10. An impact printer comprising:

a print hammer;

arcuately formed rigid frame means including a pair of opposed arms;

an actuator positioned between said arms and exhibiting an elongated dimension;

beam means spanning said arms for holding said elongated dimension of said piezoelectric actuator in compression against said frame means to inhibit actuating movement of said actuator along its elongated dimension, said beam means provided with a wave guide portion adjacent one end of said elongated dimension of said actuator;

means for resiliently biasing said print hammer against said wave guide portion; and means for energizing said actuator, whereby said actuator induces a shock wave into said waveguide portion and thence into said print hammer, said shock wave moving said print hammer to a print position.

11. The invention of claim 10 wherein said frame means is E-shaped with said actuator positioned in the middle arm of said E.

12. The invention as in claim 11 wherein said beam means spans across upper and lower arms of said E-shaped frame means.

13. The invention of claim 10 wherein said frame means is C-shaped and said beam means spans across the upper and lower arms of said C and said actuator is held between said beam means and said C-shaped frame means.

14. The invention as defined in claim 1 further comprising:

sense means connected to said actuator for detecting, after an actuation, the return of said hammer means into contact with said solid wave guide means, and, in response, for providing a signal which enables the operation of said generating means.

* * * * *